US005085196A

United States Patent [19]

Hain

[11] Patent Number: 5,085,196

[45] Date of Patent: Feb. 4, 1992

[54] FUEL INJECTION PUMP FOR INTERNAL COMBUSTION ENGINES

[75] Inventor: Josef Hain, Leonberg, Fed. Rep. of Germany

[73] Assignee: Robert Bosch GmbH, Stuttgart, Fed. Rep. of Germany

[21] Appl. No.: 623,928

[22] PCT Filed: Mar. 23, 1990

[86] PCT No.: PCT/DE90/00235

§ 371 Date: Dec. 18, 1990

§ 102(e) Date: Dec. 18, 1990

[87] PCT Pub. No.: WO90/12957

PCT Pub. Date: Nov. 1, 1990

[30] Foreign Application Priority Data

Apr. 18, 1989 [DE] Fed. Rep. of Germany ..... 3912624

[51] Int. Cl.[5] ..... F02M 37/04

[52] U.S. Cl. ..... 123/502; 123/449

[58] Field of Search ..... 123/502, 501, 500, 449, 123/179 L, 459

[56] References Cited

U.S. PATENT DOCUMENTS

| | | | |
|---|---|---|---|
| 4,334,514 | 6/1982 | Konrath | 123/502 |
| 4,359,994 | 11/1982 | Hofer | 123/502 |
| 4,366,795 | 1/1983 | Laveer | 123/502 |
| 4,475,519 | 10/1984 | Eheim | 123/502 |
| 4,510,908 | 4/1985 | Eisele | 123/449 |
| 4,522,181 | 6/1985 | Oreiner | 123/502 |
| 4,619,238 | 10/1986 | Hain | 123/502 |
| 4,733,645 | 3/1988 | Hain | 123/502 |
| 4,796,592 | 1/1989 | Hofer | 123/502 |
| 5,033,441 | 7/1991 | Hain | 123/502 |

*Primary Examiner*—Carl Stuart Miller

*Attorney, Agent, or Firm*—Edwin E. Greigg; Ronald E. Greigg

[57] ABSTRACT

A fuel injection pump for internal combustion engines, in which for supplying a very rapid pressure rise in the interior of a fuel injection pump, a pressure control valve controlling this pressure is modified such that it is reliably closed upon cold starting of the engine. To this end, a control piston of a pressure control valve is acted upon on its back side by a restoring spring which is supported on one end by an adjustable stop, which is acted upon by the pressure building up in the fuel injection pump and in so doing seeks to bias the restoring spring. This causes a closure of an outflow throttle controlled by the control piston, so that all the fuel pumped by a feed pump remains in the pump interior and contributes to increasing the pressure. With the aid of this pressure, a very rapid adjustment of an injection adjusting piston (4) is effected in a direction of an early onset of fuel injection that promotes cold starting and warmup.

3 Claims, 2 Drawing Sheets

FUEL INJECTION PUMP FOR INTERNAL COMBUSTION ENGINES

PRIOR ART

The invention is based on a fuel injection pump as defined hereinafter. Such a pump is known from German Patent Disclosure Document DE-OS 31 48 214. In it, the pressure valve provided in the relief line of the restoring chamber is controllable as a function of temperature, so that it is closed in cold starting of the engine and opened no later than once the engine is at operating temperature. The pressure valve is embodied as a check valve that is capable of opening at a maximum pressure and is pushed open by a thermostatically controlled element. As long as the pressure valve is closed, the same pressure, determined by the feed rate of the fuel feed pump, is established in both the pressure chamber and the restoring chamber, and also becomes operative at the injection timing adjuster and adjusts it toward "early". This special shift to early is cancelled at the end of the warmup phase by opening of the pressure valve, and subsequently the pressure acting upon the injection timing adjuster is controlled in a known manner as a function of rpm by the pressure control valve. The special shift toward early effects an improvement of cold starting behavior and of engine operation in the warmup phase.

A disadvantage in the known apparatus is that when the fuel injection pump is stopped a small remaining gap of the outflow throttle from the pressure chamber to the relief chamber remains open at the pressure control valve. When the fuel injection pump starts up the feed pump delivery rate is inadequate for immediately generating the required pressure at low rpm in the startup phase of the engine or fuel injection pump in the pressure chamber or restoring chamber in such a way that the special shift to early is simultaneously achieved for cold starting. The desired pressure does not become established until later, with increasing rpm and an increasing quantity supplied by the feed pump.

ADVANTAGES OF THE INVENTION

The fuel injection pump according to the invention has an advantage that the outflow throttle on the pressure control valve is closed both quickly and securely upon cold starting and that the aforementioned pressure for the shift to early upon cold starting is consistently attainable.

By means of the provisions recited herein, advantageous further features of and improvements to the fuel injection pump disclosed are possible.

DRAWING

Two exemplary embodiments of the invention are shown in simplified form in the drawing and described in further detail below.

DESCRIPTION OF THE EXEMPLARY EMBODIMENTS

Figure 1:
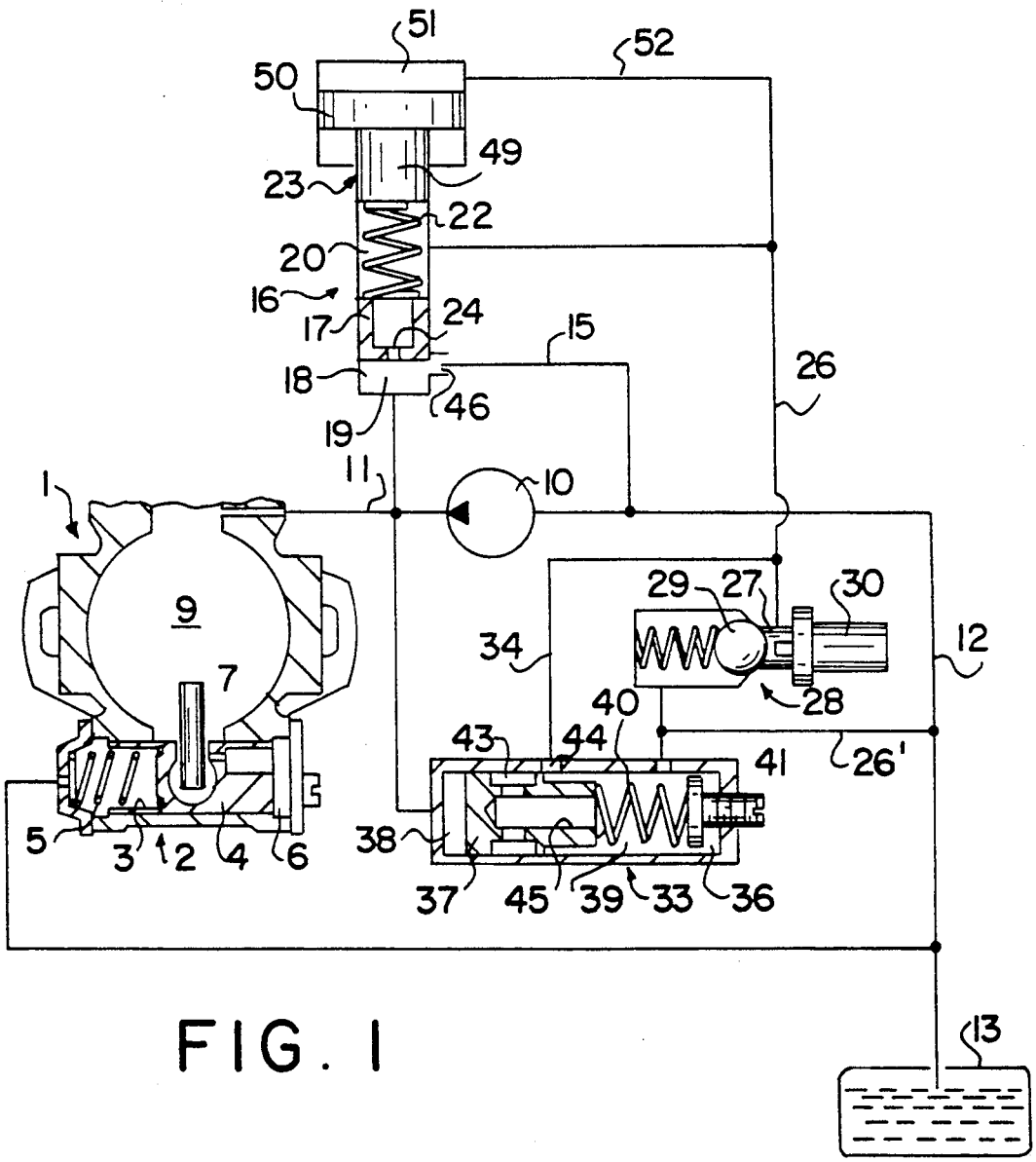
FIG. 1 shows a schematic view of a first exemplary embodiment of the fuel injection pump according to the invention.

FIG. 1 shows only part of a distributor-type fuel injection pump 1, having an injection timing adjuster 2 which has an injection adjuster piston 4 that is displaceable in a cylinder 3 and is acted upon by one face end by a restoring spring 5; the restoring spring is supported fixedly on one face end of the cylinder 3, and an injection adjuster work chamber 6 is defined in the cylinder 3 on its other face end. Via a throttle bore 7 in the injection adjuster piston, the injection adjuster work chamber 6 communicates with a suction chamber 9 in the interior of the fuel injection pump. The suction chamber 9 is supplied with fuel by a feed pump 10, driven in synchronism with the fuel injection pump 1, via a pressure line 11; the feed pump draws the fuel from an fuel supply tank 13 via a, intake line 12. A bypass line 15 in which a pressure control valve 16 is disposed is provided parallel to the feed pump 10. The pressure control valve has an adjustable wall in the form of a control piston 17, which slides tightly in a cylinder 18 and on one side defines a pressure chamber 19, into which the bypass line 15 discharges from the pressure line 11. On the other side, the control piston defines a restoring chamber 20, in which a restoring spring 22 is disposed that is supported at one end on the control piston 17 and at the other end on an adjustable stop 23. Via a throttle 24, the restoring chamber 20 communicates continuously with the pressure chamber 19. Via a relief line 52 and 26, the restoring chamber 20 also communicates with the pressure chamber 27 of a pressure valve 28, which is embodied as a pressure holding valve in the form of a check valve, the valve closing element 29 can be pushed open by a control element 30 actuated as a function of temperature. This control element is a thermostat or an expanding element, for example, which is exposed to the engine coolant and thus detects the operating temperature of the engine. Accordingly, when the engine is at its operating temperature, the closing element 29 is pushed open by the control element, causing the relief line 26 to communicate with a relief line segment 26' via line 12 which leads onward to the fuel tank 13 downstream of the valve closing element 29.

A second pressure valve 33, connected parallel to the pressure valve 28, is located in a bypass line 34 around the pressure valve 28. The second pressure valve 33 has a piston 37 that is tightly displaceable in a cylinder 36 and on one end defines a pressure chamber 38 and on the other end defines a relieved chamber 39, in which a restoring spring 40 that loads the piston 37 and is adjustable by an adjusting element 1 is disposed. The pressure chamber 38 communicates continuously with the pumping side of the feed pump 10 and thus has the same pressure that prevails in the suction chamber 9 and pressure chamber 19. By means of this pressure, the piston 37 is displaceable counter to the restoring spring and in the course of the displacement an annular groove 43 provided on the circumference of the piston, communicate with an inlet opening 44 of the bypass line 34 in the wall of the cylinder 36. Since the annular groove 43 communicates continuously with the relieved chamber 39 via a longitudinal bore 45, the bypass line 34 is made at this moment to communicate via the relief chamber 39 and a portion of the bypass line leading away from it, with the portion of the relief line 29' leading onward to the fuel supply tank 13. At that moment, the pressure valve 28 is bypassed, so that the restoring chamber 20 of the pressure control valve 16 is relieved, even if the pressure control valve 28 is closed.

The communication is established as a function of the pressure in the pressure chamber 28, which is adjustable with the aid of the adjusting element 41 or restoring spring 40. The pressure in the pressure chamber 38 is always the same as in the pressure chamber 19 of the pressure control valve, which in the final analysis controls this pressure in combination with the delivery rate of the feed pump 10, driven in synchronism with the fuel injection pump rpm. To this end, in the radial wall of the cylinder 18, the pressure control valve has an outflow throttle 46, which either communicates with the intake line 12 of the feed pump via a bypass line 15, or communicates with the relief chamber, in the form of the fuel tank 13, via the intake line 12. The cross section of the outflow throttle is determined by the position of the control piston 17 and controlled by the edge on the face end of this piston. The position of the control piston is in turn determined by the pressure in the pressure chamber 19 and the force acting on it from the restoring chamber 20. This force is essentially determined by the restoring spring 22, the initial stress of which is determined in turn by the adjustable stop 23. This stop takes the form of a stepped piston, of which the end face of the portion 49 of smaller diameter defines the restoring chamber 20 and the portion 50 of larger diameter of which encloses a work chamber 51, which communicates via a line 52 with the relief line 26 and restoring chamber 20.

Figure 3:
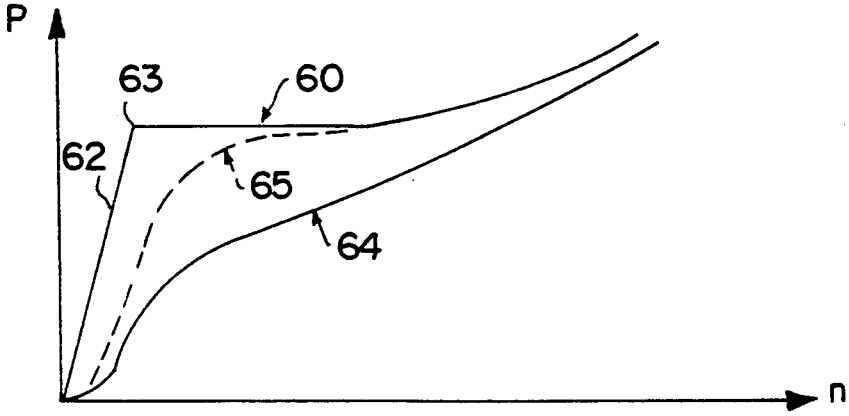
FIG. 3 shows the course of pressure in the pressure chamber upstream of the pressure control valve or of the control pressure that is operative at the injection timing adjuster, in various functional positions.

During fuel injection pump operation, the interior of the fuel injection pump is filled with fuel. Upon starting, the feed pump 10 is set in motion and generates a pressure in the suction chamber 9 and pressure chamber 19 of the pressure control valve 16. Via the throttle 24, this pressure extends into the restoring chamber 20 and from there via the line 52 into the work chamber 51 as well. This pressure rapidly effects a displacement of the adjustable stop in the direction of the control piston 17, displacing it such that the outflow throttle 46 is first securely closed. This is on the condition that in the assumed case of cold starting, the relief line 26 is closed by the pressure valve 28, and the bypass line 34 is also closed by the second pressure valve 33. Subsequently, an effective control pressure can build up very rapidly in the interior of the fuel injection pump and can now be controlled via the pressure control valve 16. Because of the existing pressure equilibrium between the restoring chamber 20 and the pressure chamber 19, however, the outflow throttle 46 continues to be closed, so that the pressure in the suction chamber 9 rises rapidly. This is shown by the characteristic curve 60 of FIG. 3. After a curve segment 62 that rises steeply, however, a pressure is attained at point 63 at which the second pressure valve 33 opens, and thus the level of the control pressure is limited to a predetermined value. The injection timing adjuster piston 4 is displaced counter to the spring 5 correspondingly early. Upon a further increase in rpm, a course of the control pressure that increases with the rpm results, since the restoring chamber 20 of the pressure control valve 16 is now relieved via the second pressure valve, and the pressure control valve, from this onset pressure, controls the pressure in the suction chamber 9 as a function of rpm, by opening the outflow throttle 46 to a variable extent. The work chamber 1 is also relieved by opening of the second pressure valve 33, so that the adjustable stop 23 returns to its normal position, and the pressure control valve 16 controls the rpm-dependent pressure in the suction chamber 9 in the desired precise manner. It has thus been attained that secure closure of the outflow throttle 46 is attained with the aid of the adjustable stop 23 and the shortened travel of the restoring spring 22 with respect to the position of this throttle 46; this effects the rapid pressure buildup and assures a rapid onset of the shift toward early for cold starting. When the engine is at operating temperature, the pressure valve 28 is opened from the outset via the control element 30; the adjustable stop 23 is in its normal position in which it relieves the restoring spring 22; and the pressure control valve 16 functions normally. Correspondingly, the resultant course of the pressure in the suction chamber 9 as a function of the rpm is in accordance with the approximately linearly rising curve 64 of FIG. 3. Without the provision according to the invention, a pressure course for the cold start would be in accordance with the curve 65, with less pronounced steepness, at the rpm onset.

Figure 2:
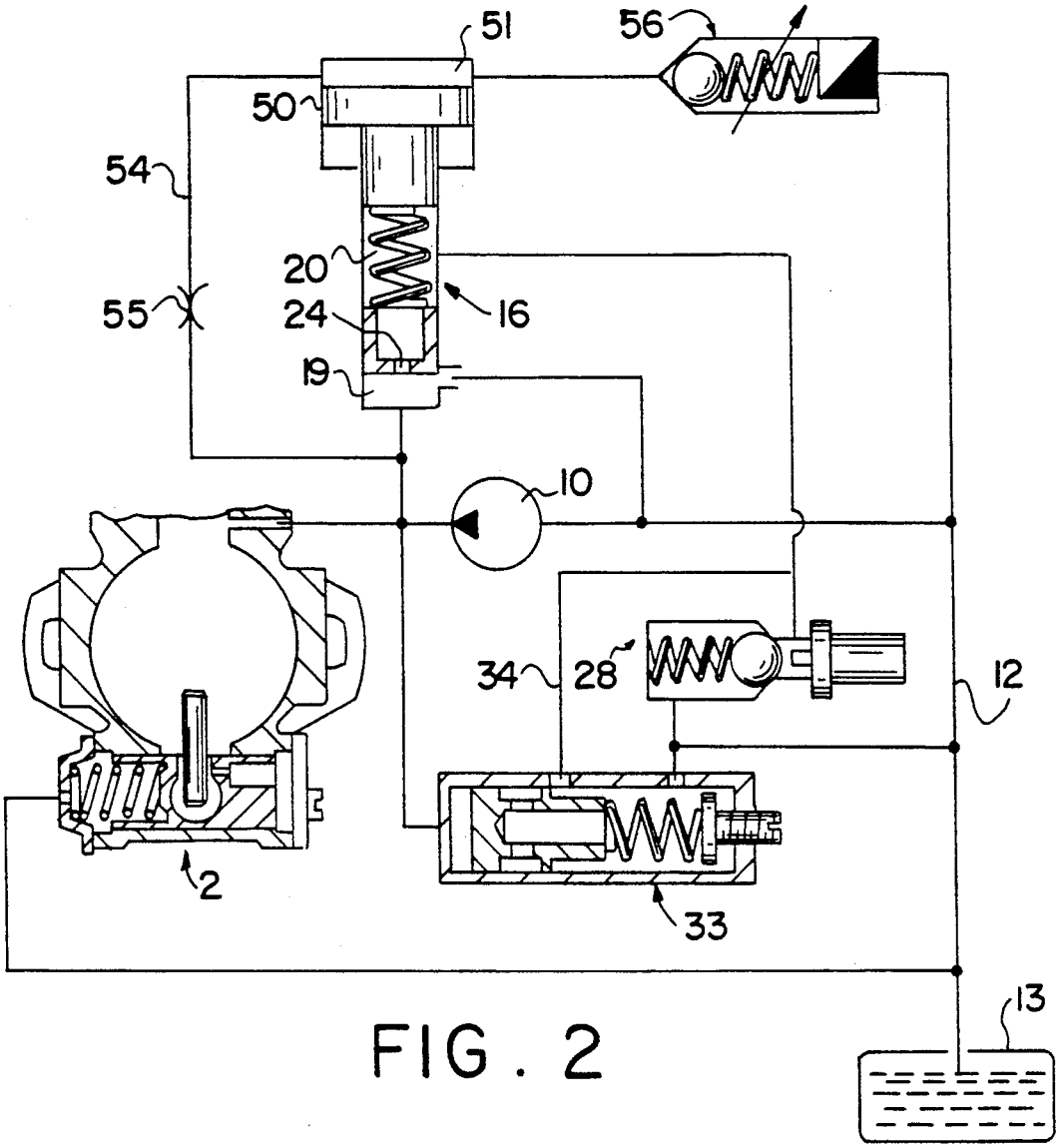
FIG. 2 shows a second exemplary embodiment of the invention.

FIG. 2 shows a variant of the embodiment of FIG. 1. In this case, the work chamber 51 communicates with the pressure chamber 19 via a separate line 54, in which a throttle 55 is disposed. The pressure chamber 51 also communicates via a one-way controllable pressure holding valve 56 with the intake line 12 of the feed pump 10, and with the relief chamber 13. In this case, the throttle 55 assumes the decoupling function that the throttle 24 of FIG. 1 had, as a connecting element with the work chamber 51. The controllable pressure holding valve 56 also functionally replaces the pressure valve 28 or the second pressure valve 33. With the controllable pressure valve, the pressure in the work chamber 51 can now be controlled more precisely, taking specific parameters into account. For this pressure holding valve as well, the primary parameter is the temperature.

The foregoing relates to preferred exemplary embodiments of the invention, it being understood that other variants and embodiments thereof are possible within the spirit and scope of the invention, the latter being defined by the appended claims.

I claim:

1. A fuel injection pump for internal combustion engines, in particular for distributor-type injection pumps, having an injection onset adjuster (2), said injection onset adjuster (2) includes an adjuster piston (4) that is adjustable counter to a restoring force (5) by an rpm-dependent control pressure of a pressure medium, a feed pump (10) driven in synchronism with the fuel injection pump and the feed pressure of which is controlled as a control pressure by a pressure control valve (16), divides a pressure chamber (19) from a restoring chamber (20) that receives the restoring spring (22), said restoring chamber communicates continuously with the pressure chamber (19) via a throttle (24), wherein upon a control motion of the adjustable control piston (17) an outflow throttle (46) from the pressure chamber (19) to a relief chamber (13) is controlled and the restoring chamber (20) communicates with the relief chamber (13) via a relief line containing a controllable pressure valve (28, 56), said restoring spring (22) of the pressure control valve (16) is supported on an adjustable stop (23), which on a side remote from the restoring chamber (20) has a pressure face that is larger than the side toward the restoring chamber, which pressure face defines a work chamber (51) that communicates via a throttle (24, 55) with the pressure chamber (19) of the pressure control valve (16).

2. A fuel injection pump for internal combustion engines as defined by claim 1, in which said throttle (55) is located in a line (54) between the pressure chamber (19) and work chamber (51), and the work chamber can be made to communicate with the relief line (13) via a controllable pressure holding valve (56).

3. A fuel injection pump as defined by claim 2, in which the holding pressure of the controllable pressure holding valve is controllable as a function of the temperature.

* * * * *